US007089981B2

(12) United States Patent
Gambini

(10) Patent No.: US 7,089,981 B2
(45) Date of Patent: Aug. 15, 2006

(54) GLUING UNIT FOR ONE TERMINAL EDGE OF A LOG

(76) Inventor: Giovanni Gambini, Via A. Omodeo 7, I-56124 Pisa (IT)

( * ) Notice: Subject to any disclaimer, the term of this patent is extended or adjusted under 35 U.S.C. 154(b) by 204 days.

(21) Appl. No.: 10/760,977

(22) Filed: Jan. 20, 2004

(65) Prior Publication Data

US 2004/0144495 A1 Jul. 29, 2004

(30) Foreign Application Priority Data

Jan. 23, 2003 (IT) ..... MI03A0101

(51) Int. Cl.
*B32B 31/00* (2006.01)

(52) U.S. Cl. ..... 156/357; 156/356; 156/446; 156/450; 156/455; 156/456

(58) Field of Classification Search ..... 156/356, 156/357, 361, 446, 455, 578, 456, 450, 187, 156/448, 449
See application file for complete search history.

(56) References Cited

U.S. PATENT DOCUMENTS

| | | | |
|---|---|---|---|
| 5,242,525 | A | 9/1993 | Biagiotti |
| 5,681,421 | A | 10/1997 | Biagiotti |
| 6,372,064 | B1 | 4/2002 | Butterworth, et al. |
| 2002/0040676 | A1 * | 4/2002 | Gambini ..... 118/249 |

FOREIGN PATENT DOCUMENTS

| | | |
|---|---|---|
| EP | 0 742 169 | 11/1996 |
| EP | 1 197 453 | 4/2002 |

OTHER PUBLICATIONS

EPO Search Report.

* cited by examiner

*Primary Examiner*—George Koch
(74) *Attorney, Agent, or Firm*—Hedman & Costigan, P.C.

(57) ABSTRACT

A gluing unit for one terminal edge of a log and a method applicable inside a machine for the realisation of a log, in which the logs (14) coming from a rewinding machine are fed towards a gluing unit (11) comprising in sequence a lower unwinding roller (16), and a upper feeder belt (17, 26), and immediately downstream of the unwinding roller (16) at least one section of a sloping plane surface (21, 23) of a pre-established length, followed by a vacuum suction roller (24) above which is positioned an upper roller (25), and then a glue distributor (27), an element (19) being envisaged above the unwinding roller (16) which blows on a terminal edge (29) of the log (14) and underneath a photocell (20) to detect the final edge (21), an evacuation surface (34) for the glued log being envisaged, wherein the log fed by the unwinding roller (16) is placed with the position of the free end out of alignment by an angle ($\alpha$) according to the log diameter and the pre-established length of the sloped surface section (21, 23) so that the log in this position, rolls down the sloped surface (21, 23) to position itself on the suction roller (24) with its free end of the final edge (29) placed exactly in correspondence with the contact zone with the suction roller (24).

8 Claims, 6 Drawing Sheets

GLUING UNIT FOR ONE TERMINAL EDGE OF A LOG

Figure 1:
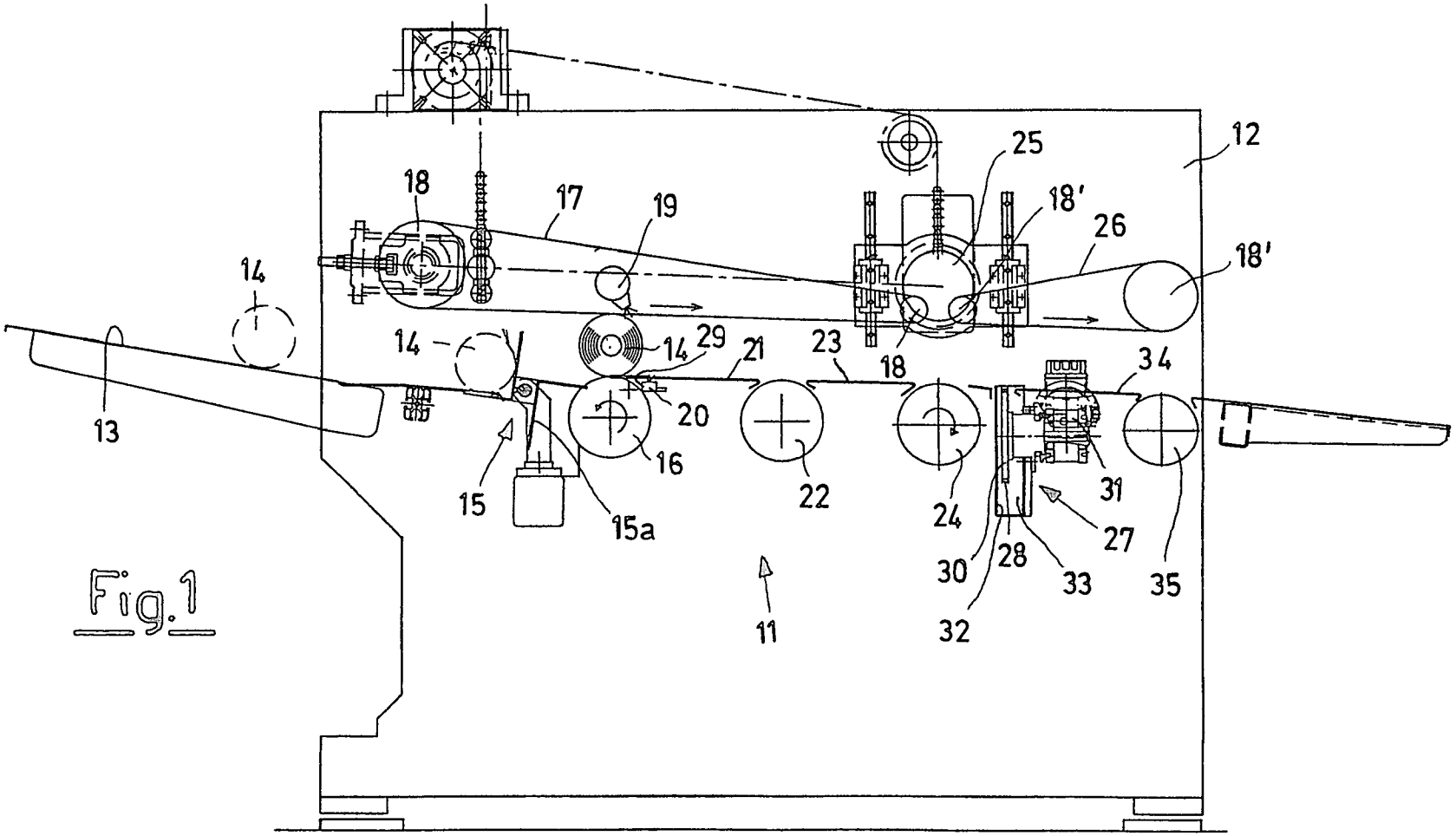

The present invention relates to a gluing unit of the terminal edge of a log.

In order to realise toilet paper rolls, kitchen paper rolls and the like called "logs", it is currently known that once the paper has been wound, glue must be distributed or positioned in various manners either on a terminal edge of the single formed log, or on a portion of the roll comprising the log to obtain stable reciprocal attachment on the finished log.

In fact the glue is used to attach the final edge and the remaining part of the winding that can then be cut into several small rolls of the required limited size, to obtain a number of finished rolls.

At the moment, glue is applied either by means of glue spray distributors or by passing the final edge, or the roll over a slot through which the glue is distributed by overflowing once the final edge has been unwound for the appropriate portion from the rest of the winding.

Although these well-known gluing units work sufficiently well, it can happen that they do not feed or distribute the glue in a uniform manner or exactly in the position required.

In fact, using glue spray distributors the glue being emitted through said distributors, the glue is not always spread in a straight and continuous manner and can also create glue deposits on undesired parts of the paper or it also tends to soil the whole machine. Moreover, it must be considered that distributors are delicate and need to be controlled and adjusted so that they do not use too much or too little glue.

On the other hand, when the glue is distributed using the "overflow" method, over which the final edge of the log, or the log itself is passed, soiling can occur throughout the whole machine and even in the log, due to both the quantity of glue as well as the glue that is disseminated by the paper, or that accidentally overflows from the slot.

It must also be considered that the gluing units of a terminal edge of a log are particularly complicated from a constructive point of view in general, and from the viewpoint of the interaction between the various parts that contribute to log travel, unwinding the terminal edge, or at least a portion of it, and permitting the application of the glue on the edge.

The aim of the present invention is therefore to find a different solution to the aforesaid technical problem of correct distribution or positioning of the glue, thus resolving the problems of prior art related to the whole gluing unit of the terminal edge of the log.

Another aim is to realise a unit adapted to perform the aforesaid task that is particularly simple to implement even in large-scale production.

These aims, according to the present invention are achieved by realising a gluing unit for a terminal edge of a log as described in the appended claim 1.

Further recognisable and special characteristics of the present invention are the object of the subordinate claims.

Figure 2:
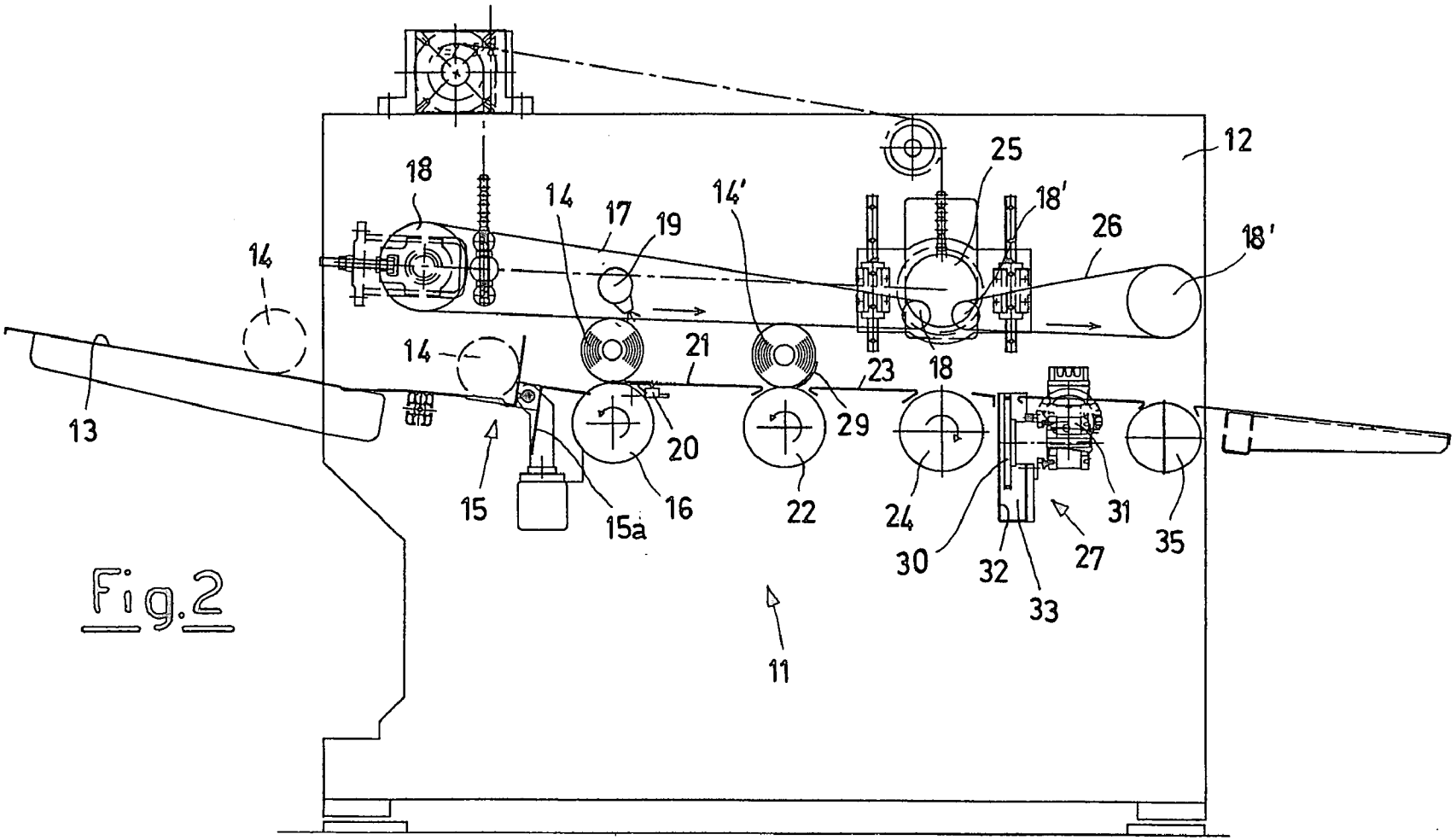
Figure 2A:
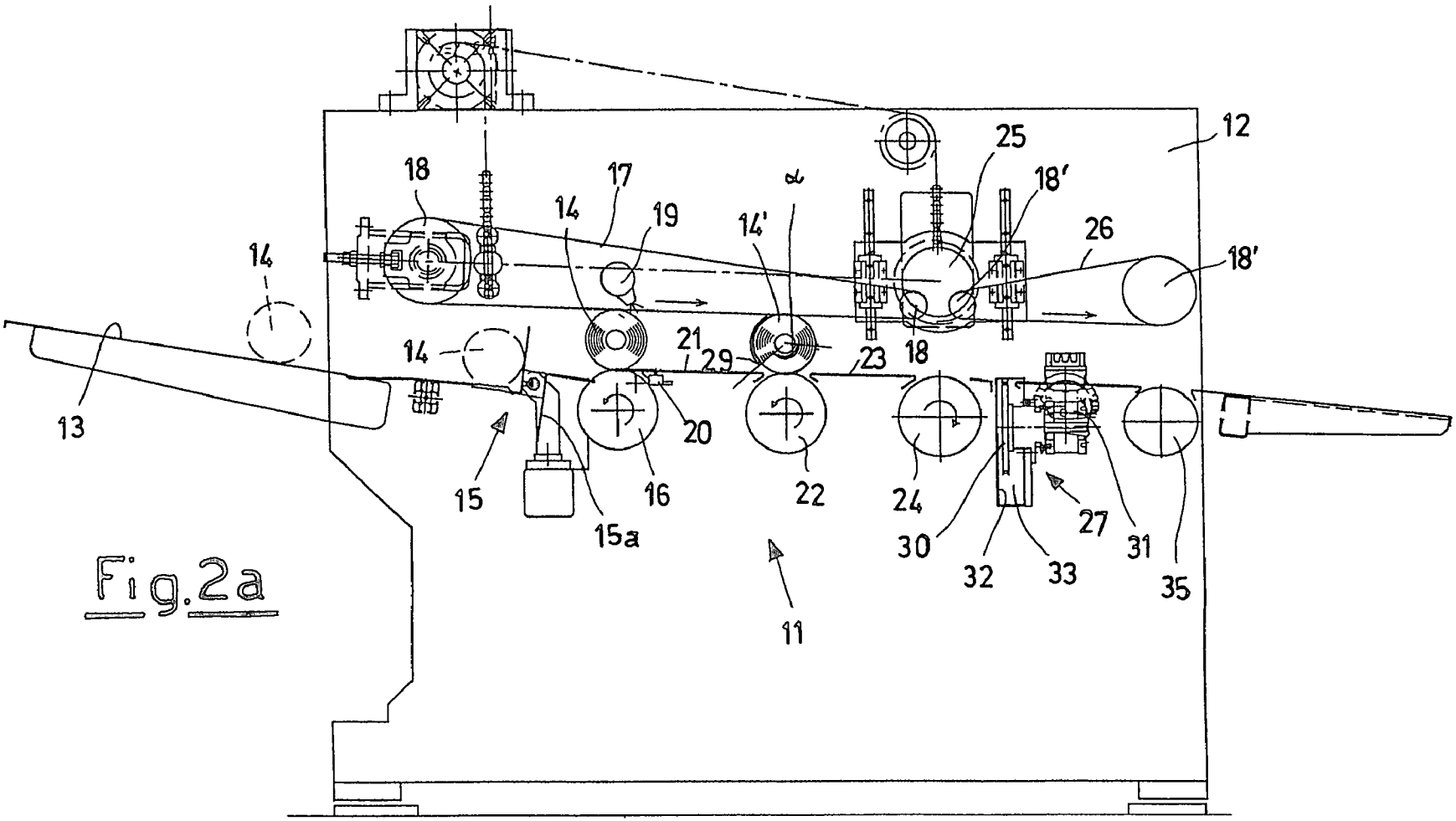
Figure 3:
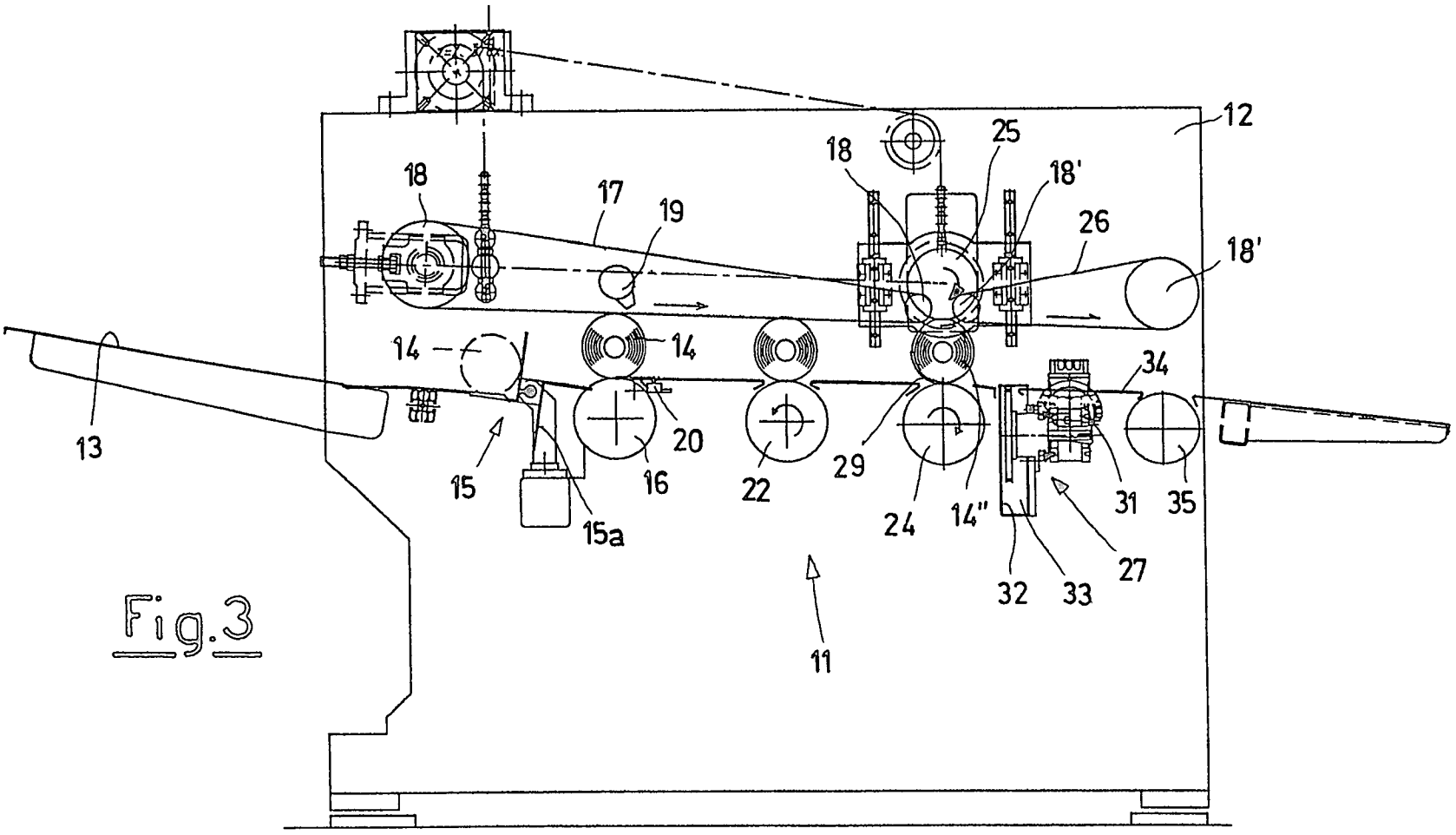
Figure 4:
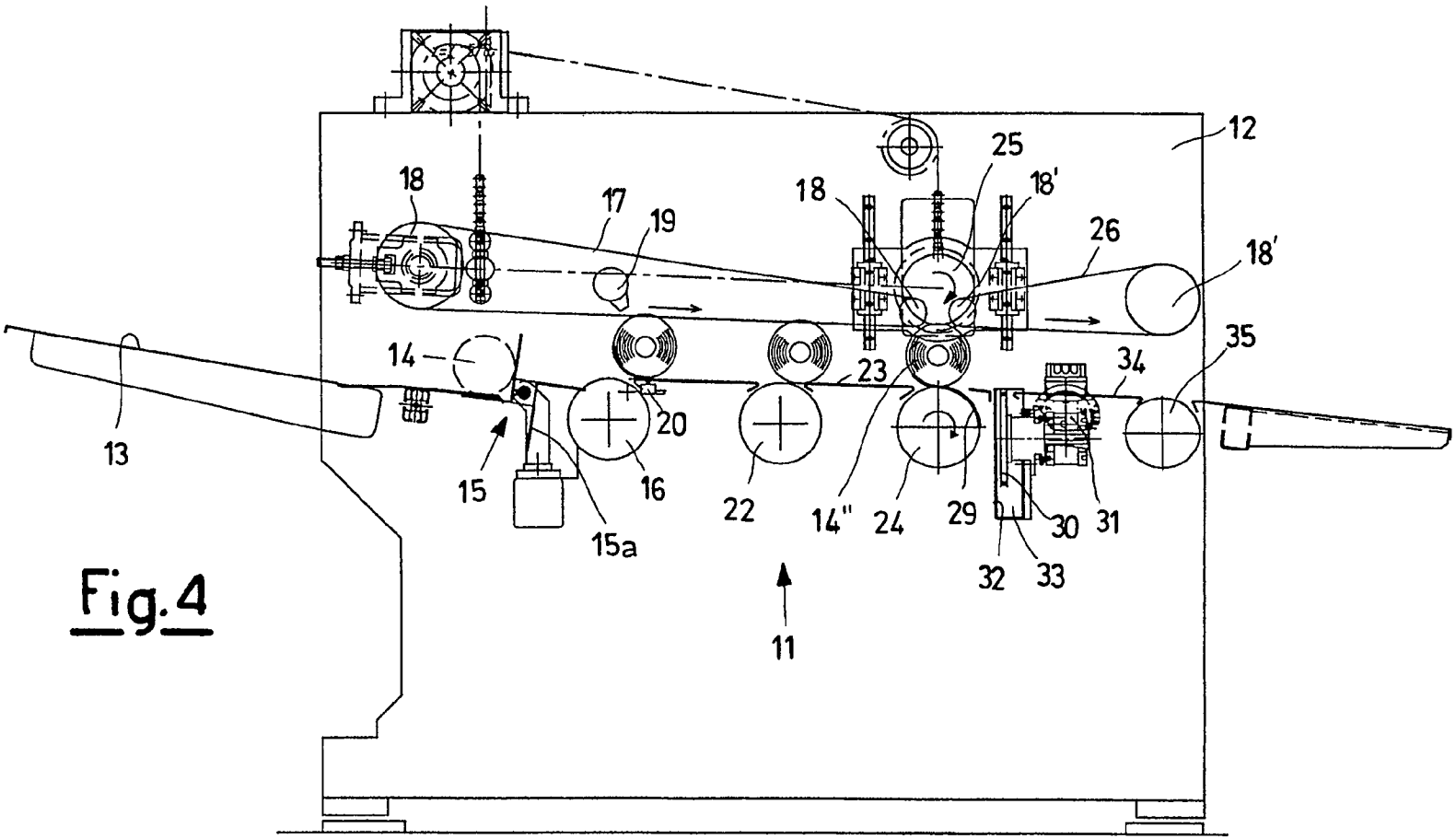
Figure 5:
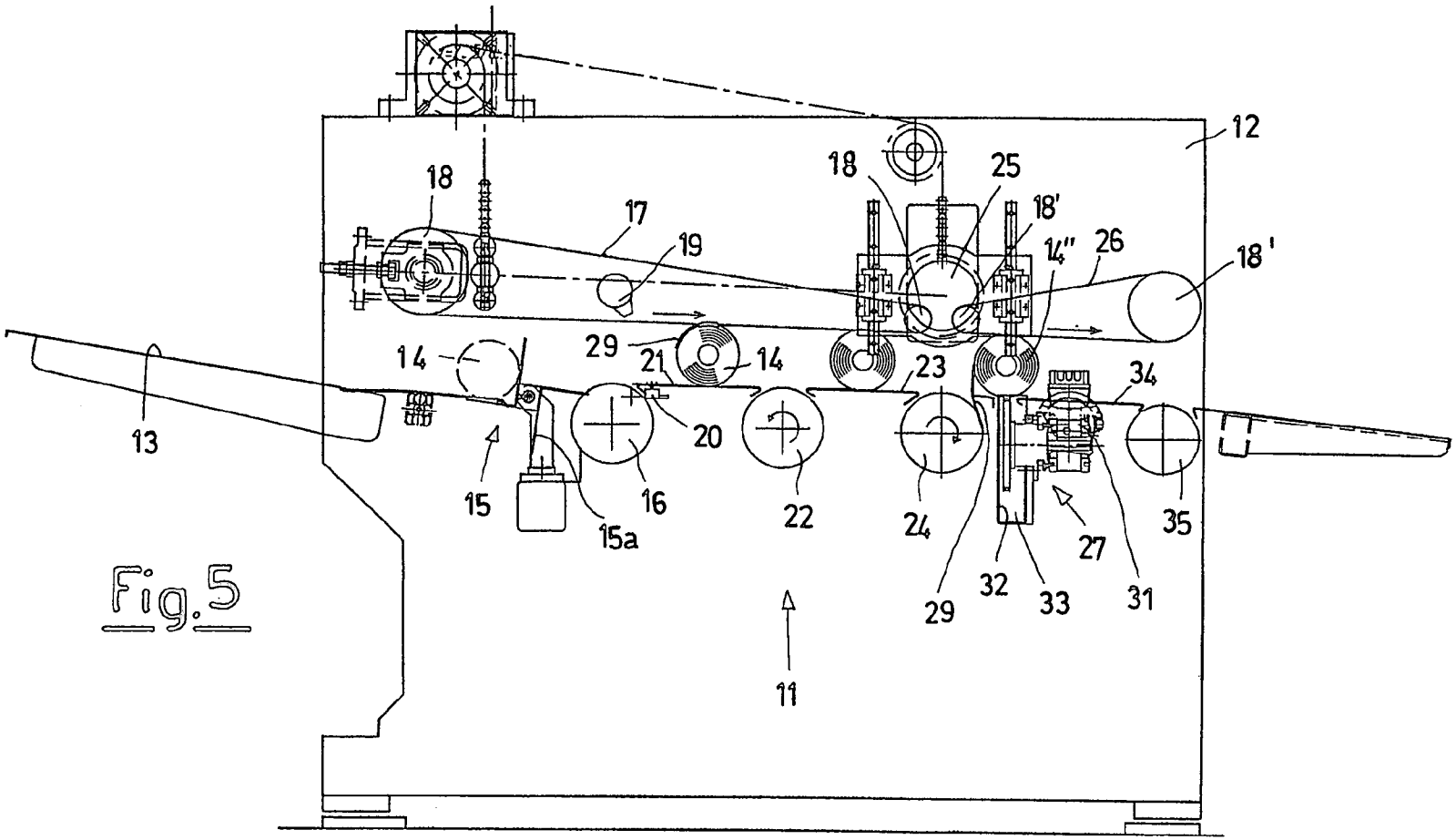

The characteristics and advantages of a gluing unit of the terminal edge of a log according to the present invention will be made clearer and more obvious in the following description provided as an example that is by no means limitative, in an embodiment with reference to the appended figures wherein:

FIG. 1 is a side elevation of a partial section of a unit according to a first embodiment of the present invention in a first operative position wherein the log is blocked between one unwinding roller and a conveyor belt, FIGS. 2 and 2*a* are similar views to that shown in FIG. 1 in a second operative position, during the following stage, with two logs being fed along the path towards the position where the glue is applied, FIG. 3 is a similar view to that shown in FIG. 1 in a third operative position with three logs being fed along the path towards the zone where the glue is applied, FIG. 4 shows how a first log being fed in the third operative position, is placed in order to take up the glue, and FIG. 5 shows in a final section of the third operative position, how the said first log being fed is reversed to receive the glue.

A gluing unit of the terminal edge of a log is shown with general reference to FIGS. 1–5, and identified throughout with numeral 11, mounted in a machine for log forming. A support structure 12 of the machine provides for a sloped feeder surface 13 to feed the logs (14) one after the other, indicated in the various positions by 14', 14", 14''', etc, for easier understanding, after their arrival from a previous rewinding machine positioned upstream.

At the end of the sloping feeder surface 13 is envisaged a star type rotating sorting device 15 provided with a series of pockets 15*a*, to receive each individual log 14, and which directs the logs one after the other towards the following actual gluing unit 11. According to the present invention, this gluing unit 11 envisages a first unwinding roller 16, driven by an independent motor and positioned lower than the first feeder conveyor belt 17. The feeder belt 17 is positioned above the gluing unit 11 and is mounted in ring form on a pair of end pulleys 18.

Immediately downstream of the unwinding roller 16 but in a higher position, is an air nozzle 19 and in a lower position, a sensor 20 such as a photocell. Then at the exit of the unwinding roller 16 is positioned a first section of the sloped surface 21 leading to a second roller 22, defined as timer controlled and also driven by an independent motor. Downstream of this second timing roller 22, a second section of sloping surface 23 is envisaged, leading to a third roller 24, defined as the suction roller and also driven by an independent motor. This third roller is a suction roller 24, connected to a vacuum source (not illustrated) and perforated on its total external side surface with suction holes for this purpose.

This third suction roller 24 is positioned aligned under an upper roller 25 also driven by an independent motor, that can be moved vertically to approach or move away from the suction roller 24. The upper roller 25 is positioned exactly at the end of the first conveyor feeder belt 17 before the beginning of the second feeder belt 26, also positioned above the log 14 travel path, and also mounted in ring form on the two pulleys 18'. Alternatively, this second feeder belt 26 can be simply an extension of the first belt 17.

Underneath the second feeder belt 26 and immediately after the suction roller 24 is envisaged a glue distributor 27 of any type whatsoever. In the example provided, this glue distributor 27 comprises a wire 28 that is positioned in a crosswise direction in relation to the travel direction of the final end 29 that protrudes from the paper log 14. In this example the wire 28 is closed loop type wound on end pulleys 30, in the example two, only one of which is illustrated and at least one of which being driven in continuous rotation by a gear motor 31. The pulleys 30 are pivotally supported on the walls 32 of a container or tank 33 containing an adhesive.

Lastly a sloping evacuation surface 34 is envisaged over which the second feeder belt 26 is laid to ensure the attachment between the terminal edge 29 of the log 14 and the log or roll itself, thus realising the tight glue attachment.

The operation of a glue unit for a terminal edge of a log of material 11 mounted in a machine to realise finished logs is extremely simple.

The logs 14, wound practically to their final size are fed onto the sloping surface 13 in arrival from the previous rewinding machine on the production line. Each single log 14 drops into an available pocket on the rotating sorting device 15 and is therefore fed according to a pre-established sequence towards the gluing unit 11 of the present invention.

In fact, the log 14 is placed on the unwinder roller 16 positioned in a lower position, and maintained by the upper feeder belt 17. The unwinder roller 16 rotates in an anti-clockwise direction, while the feeder belt 17 travels in a manner such that it exercises a certain pressure on log 14, while rotating it at the same time. In this manner, the terminal edge 29 of log 14 is transferred through the log 14 rotation to the blowing element 19. This blowing element 19 acts to open the terminal edge away from the rest of the log 14 and photocell 20 (FIG. 1) detects whether the edge opening is sufficient and correct.

At this point the unwinding roller 16 stops and the continuing forward travel motion of the upper feeder belt 17 induces log 14 to roll onto the first section of the sloping surface 21 to travel forward towards the second timing roller 22.

In this second position, the log, identified by numeral 14' in FIG. 2 and positioned between the second timing roller 22 and the upper feeder belt 17, is induced to roll on itself again at a certain angle α. Accordingly, at the end of the rotation action, roll 14' is set in a pre-established position with the end of the terminal edge 29 in a pre-selected position in relation to the log diameter as shown in FIG. 2*a*.

Once this position of the terminal edge 29 of log 14' has been identified—i.e. its end calculated previously according to the diameter of the log being processed, the second timing roller 22 stops and log 14' is induced to roll forward again by the upper feeder belt 17. In fact this feeder belt 17 induces the log 14' to roll forward on the second sloping surface 23 having a pre-defined and established length, towards the suction roller 24. Thanks to this rolling action the log reaches its position with the free terminal edge 29 exactly in the area in contact with the suction roller 24 (indicated at 6 o'clock on the clock in FIG. 3). More precisely, the log, identified by 14" in FIG. 3, is positioned between the upper roller 25 and the suction roller 24.

At this point the suction roller 24 is activated to roll in a clockwise direction, and upper roller 25 is also activated to roll in a clockwise direction. Accordingly, the terminal edge 29 unwinds for the pre-determined quantity, as shown in FIG. 4.

Once this operation is completed, the halt of the upper roller 25 determines the forward travel of log 14", while the terminal edge 29 is maintained in position by suction roller 24. In this manner, as is visible in FIG. 5, the upper belt 26 induces log 14" to roll on the wire 28 that transfers the glue towards the roll taking it from the container 33.

Once the glue has been applied, the terminal edge 29 is released by the suction roller 24 and the upper belt 26 induces the rolling of log 14" down the sloping evacuation surface 34 so that the glue remains inside the log between the log itself and the terminal edge 29, attaching them together.

A roller 35 positioned on the sloping evacuation surface 34 rotates so that the glued part is transferred to the upper part of the log preventing the soiling of the surface.

In this way it is easy to understand how the second section of the sloped surface 23 positioned before the suction roller 24, acts to regulate and time the terminal edge 29 position—i.e., the free end, according to the diameter of the log in question. This permits the unit to treat logs or various diameters with the simple rotation variation of the timing roller 22.

The rotation that is varied in this manner, like the final position of the different log assumed on the timing roller 22, permit the log, whatever its diameter, to reach the position above the suction roller 24, i.e. between the suction roller and the upper roller 25, always in the said position with the final terminal edge 29 arranged exactly in the area in contact with the suction roller 24 (6 o'clock on the clock).

In this manner the glue is correctly positioned on a log to glue the terminal edge of the log rapidly and in a precise manner. This positioning action is performed in rapid succession with several logs undergoing the same process.

This method has resolved the problems described in the introduction in relation to gluing units of prior art and used in the field of realising logs to produce toilet paper rolls, kitchen paper rolls, and the like. The unit of the present invention thus conceived could be subjected to numerous modifications and variants, all of which remain within the scope of the invention itself.

Moreover, in practice, all the materials used as well as their measurements and components can be of any type according to technical needs.

In a possible embodiment equivalent to that described above, applying the inventive concept of the present invention, the elimination of the timing roller can be envisaged.

In this manner the section of sloping surface (21 or 23) would have a variable length according to necessity, and the suction roller (24) and the gluing unit (27) would be moveable to approach or move away from the unwinding roller (16) according to the diameter of the log on the machine.

This possible arrangement would also realise a gluing unit for a terminal edge of a log according to the present invention.

What is claimed is:

1. Gluing unit for the terminal edge of a log positioned on a support structure (12) of a machine for realizing logs, wherein said structure (12) envisages a sloping feeder surface (13) for feeding the logs (14) coming from a rewinding machine and wherein the end of said sloping feeder surface (13) is mounted with a rotating sorting device (15) provided with a series of pockets (15*a*) to receive the individual logs (14) and to feed them towards an actual gluing unit (11) characterized in that said gluing unit (11) comprises in sequence, a lower unwinding roller (16), and at least one upper feeder belt (17, 26), that collaborate towards the forward travel of said logs and to the evacuation of the glued log towards an evacuation surface (34), and immediately downstream of said unwinding roller (16), a first section of sloping surface (21) followed by a timing roller (22) in turn followed by a second section of sloping surface having a pre-established length (23) followed finally by a suction roller (24) connected to a vacuum source over which is positioned an upper roller (25) which can be height adjusted and which cooperates with said suction roller (24) so that the suction roller holds the terminal edge (29) of said log, and a successive glue distributor device (27), also envisaged in a position higher than said unwinding roller (16) is a blowing element (19) for the terminal edge (29) of said log (14) and, in a lower position, a photocell (20) that interacts to detect said terminal edge (29) of said log (14), said log being positionable by said timing roller (22) with a free end of the log's terminal edge (29) in a position set by an angle (α) according to the diameter of the log and the final position on said suction roller (24) and such that the free end of the terminal edge (29) is positioned in the area in contact with said suction roller (24) when the log reaches said suction roller (24) by means of a rolling action along said second section of the sloping surface with the pre-established length (23) located upstream of said glue distributor device (27).

2. Gluing unit according to claim 1, characterized in that rotation of said log (14') when positioned between said second timing roller (22) and said at least one upper feeder belt (17, 26) is activated in order to place the free end of the final edge (29) out of alignment by a certain angle (α) in relation to its arrival position so as to place said final edge (29) in a pre-defined position according to the diameter of the log (14').

3. Gluing unit according to claim 1, characterized in that said suction roller (24) having received said log in the position with the free end of the final edge (29) placed exactly in the area in contact with said suction roller (24), rotates in a clockwise direction like said upper roller (25) to unwind the final edge (29) for the pre-established amount.

4. Gluing unit according to claim 3, characterized in that once the pre-established amount of the final edge (29) has been unwound, said upper roller (25) is blocked to induce the forward travel of said log over said glue distributor device (27) in cooperation with said at least one feeder belt (17, 26) that collaborates to evacuate the glued log towards said evacuation surface (34).

5. Gluing unit for a terminal edge of a log positioned in a support structure (12) of a machine for the realizing of logs, wherein said structure (12) provides a sloping feeder surface (13) to feed logs (14) coming from a rewinding machine, and on the end of said sloping feeder surface (13) is envisaged a rotating sorting device (15) provided with a series of pockets (15*a*) to receive the individual logs (14) and to feed them towards an actual gluing unit (11) characterized in that said gluing unit (11) comprises in sequence a lower unwinding roller (16), and at least one upper feeder belt (17, 26), and immediately downstream of said unwinding roller (16) a first section of sloping surface (21) followed by a timing roller (22) in turn followed by a second section of sloping surface (23) of a pre-established length followed by a suction roller (24), which cooperates with said suction roller (24) so that the suction roller holds the terminal edge (29) of a log, connected to a vacuum source, over which is positioned an upper roller (25) adjustable in height in relation to said suction roller (24) and followed by a glue distributor device (27), also being envisaged in a position higher that said unwinding roller (16) is a blowing element (19) for the terminal edge (29) of said log (14) and in a lower position, a photocell (20) that interacts to detect said terminal edge (29) of the log (14), and being envisaged last of all, an evacuation surface (34) for the glued log whereon the log fed by said unwinding roller (16) is positioned with a free end of the final edge indicated by an angle (α) according to the diameter of the log the first section of sloping surface (21), the timing roller (22) and said second section of sloping surface (23) having a pre-established length so that when said log positioned in this manner rolls towards the gluing distribution device (27) on said at least one sloping surface (21, 23) it is positioned on said suction roller (24) with its free end of the terminal edge (29) positioned exactly in the area in contact with said suction roller (24).

6. Gluing unit according to claim 5, characterized in that said suction roller (24) having received said log in the position with the free end of the final edge (29) placed exactly in the area in contact with said suction roller (24), rotates in a clockwise direction like said upper roller (25) to unwind the final edge (29) for the pre-selected amount.

7. Gluing unit according to claim 6, characterized in that once the pre-established amount of the terminal edge (29) has been unwound, said upper roller (25) is blocked to induce the forward travel of said log over said glue distributor device (27) in cooperation with said at least one feeder belt (17, 26) that collaborates with the evacuation of the glued log towards said evacuation surface (34).

8. Gluing unit according to any one of the previous claims, characterized in that said at least one feeder belt (17, 26) comprises a first feeder belt (17) upstream of said upper roller (25) and a second feeder belt (26) downstream of said upper roller (25).

* * * * *